United States Patent [19]

Anderson et al.

[11] Patent Number: 4,828,609

[45] Date of Patent: May 9, 1989

[54] METHOD TO PROTECT THE SURFACE OF METAL IN VERTICAL MELTING FURNACES

[75] Inventors: Sara H. Anderson, Westmont; Jocelyne McGeever; Casey McGeever, both of LaGrange, all of Ill.; Greg Carr, Indianapolis, Ind.

[73] Assignee: Liquid Air Corporation, Walnut Creek, Calif.

[21] Appl. No.: 162,655

[22] Filed: Mar. 1, 1988

[51] Int. Cl.[4] ..... C22B 9/00
[52] U.S. Cl. ..... 75/96
[58] Field of Search ..... 75/96

[56] References Cited

U.S. PATENT DOCUMENTS 4,518,421 5/1985 Foulard ..... 75/96

*Primary Examiner*—Peter D. Rosenberg
*Attorney, Agent, or Firm*—Lee C. Robinson, Jr.

[57] ABSTRACT

Inert liquid gas such as liquid nitrogen or liquid argon is used in vertical melting furnaces to prevent oxidation of the metal during holding periods. The method can be applied to any kind of metal. The use of inert liquid gas for the "blow-dow" of the furnace will flush art all existing furnace atmosphere and prevent oxidation. The casting recovery time may be reduced from about one hour to 15 minutes. Also the layers of oxide resulting from oxidation can be negated, allowing for fewer rejects, if any, during further surface treatment.

7 Claims, 2 Drawing Sheets

METHOD TO PROTECT THE SURFACE OF METAL IN VERTICAL MELTING FURNACES

BACKGROUND OF THE INVENTION

Molten copper or the like produced in a vertical furnace drains away through refractory lined "launders" into a holding furnace also having reducing gas burners. From the holding furnace, the copper is transferred to a water cooled casting wheel from which copper rod emerges.

When a vertical melting furnace is used with a holding furnace and at least one casting wheel, the objective is to keep the casting wheels busy all the time, but occasionally casting is stopped for any of several reasons. Since there is limited capacity in the rotary holding furnace, halting the casting wheel for more than a few minutes means that the flow of molten copper to the holding furnace must be stopped.

The standard industry practice is to "blow down" the vertical melting furnace with high flows of air to cool the melting copper below the melting point.

There are two reasons for having a rapid blow down: first to prevent overflow of the holding furnace, and second to prevent the soft, melting copper in the furnace from slumping to the bottom and congealing in a solid mass. If the latter occurs, several weeks are required to repair the furnace. Generally, the vertical melting furnace charge is a random mix of outside scrap copper, scrap rod being reprocessed, and so called "cathode" (pure copper plates produced to feed the vertical melting furnace). The temperature at the top of the vertical melting furnace is about 300° F., and the bottom 2200° F. There is normally less than 1" of molten copper in the bottom of the vertical melting furnace.

The problem when using air for blowing down the vertical melting furnace is that the entire exposed surface of the melting copper charge is oxidized by the air. Some oxidation occurs even at 250° F., and the charge at the bottom of the furnace is grossly oxidized by using air to blow down the furnace. Furthermore, it is thought that significant oxidation may occur in less than 1 minute, perhaps in less than 15 seconds.

After an air blow down of one hour (a typical time period), the vertical melting furnace is restarted and the first molten copper produced is heavily oxidized. This copper flows into the holding furnace and is diluted. However, the effect of the introduction of excess oxides into the system is to produce copper rod with layers of oxide inside the rod (and hence not amenable to any later surface treatments). Internal layers of oxide cause the rod to be breakable, and to make unacceptable copper wire. Consequently, a normal one hour of scrap copper production follows an air blow down of the vertical melting furnace. This scrap is recycled back to be used as charge in the vertical melting furnace.

SUMMARY OF THE INVENTION

It is an object of the invention to narrow the duration of scrap copper production following an interruption of the flow of molten copper or the like to the holding furnace.

The invention provides a method to prevent oxidation during holding periods of a metal melted in a vertical melting furnace wherein said metal is melted by means of burners and flows down to a holding furnace adapted to feed a casting wheel to cast metal rods or the like, said melting of metal being occasionnally stopped during holding periods and then restarted, comprising the steps of shutting off the burners, simultaneously injecting a cryogenic inert liquid on the surface of the molten metal with a flowrate sufficient to flush out air above the molten metal bath, maintaining said flowrate on said molten metal during not more than 10 minutes in order to get a non oxidizing atmosphere above said bath of molten metal, then injecting a reduced flowrate of said cryogenic liquid above said metal to maintain said non oxidizing atmosphere until said burners are restarted.

Inert cryogenic liquid such as liquid nitrogen or liquid argon is used to blow down the vertical melting furnace to flush out the existing furnace atmosphere, and to overcome any "chimney effect" caused by air flow up. Injection of liquid nitrogen is made e.g. via stainless steel injector assembly. The injectors are designed to flood the furnace with a downward directed spray of inert cryogenic liquid such as liquid nitrogen, so that the conversion from liquid to gas would occur in the bottom of the furnace and promote a plug flow departure of the previous furnace atmosphere via the roof charge port of the vertical melting furnace.

According to a preferred embodiment, the method according to the invention comprises the following steps : after estimation of the volume of gas assumed to be present in the furnace, it is required to purge this volume by the injection of inert cryogenic liquid which vaporizes: a rate of five atmosphere changes per minute appeared to be adequate. This flow has to be maintained from about 2 to 5 minutes, and then to be followed by a flow of substantially one atmosphere change per minute until the end of the blow down.

BRIEF DESCRIPTION OF THE DRAWINGS

Other and further features of the invention will be clearly understood by reference to the following description of various embodiments of the invention, chosen for purpose of illustration only, along with the claims and the accompanying drawings, wherein :

Figure 1:
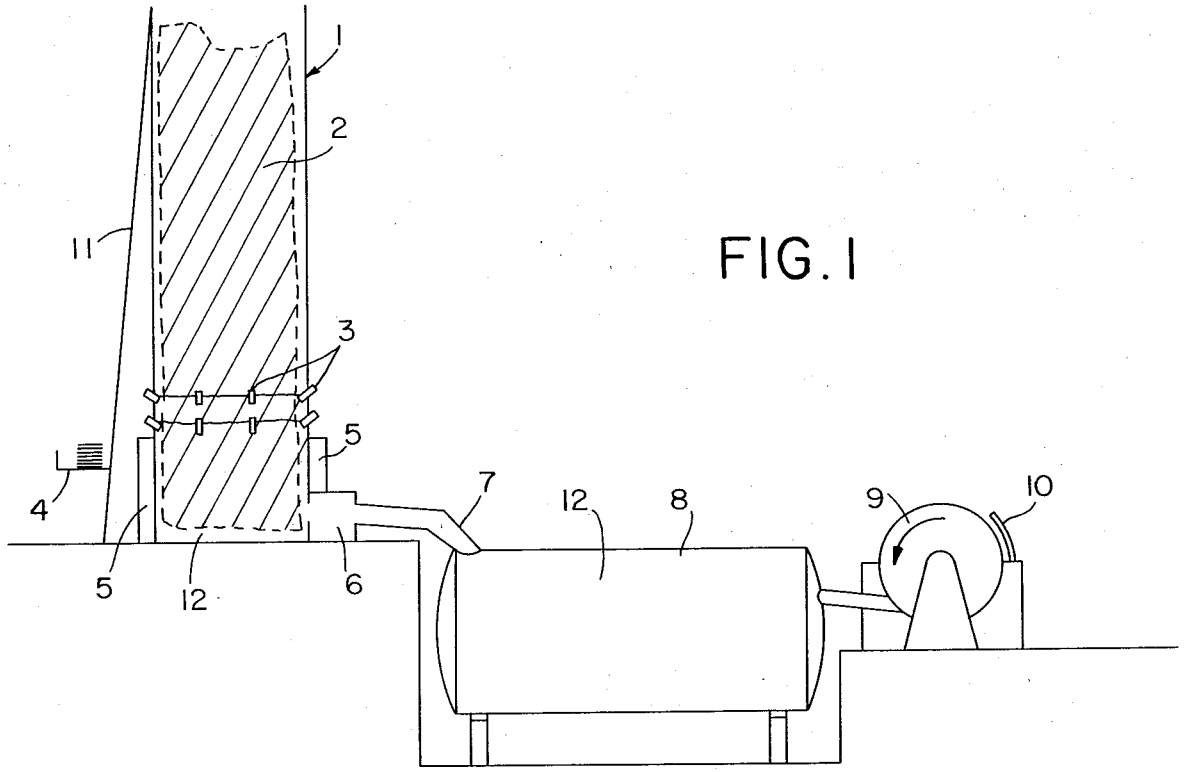
FIG. 1 is a schematic view of an apparatus for casting copper wire from a vertical melting furnace.

On FIG. 1, the vertical melting furnace 1 contains melting copper which melts under the reducing burners action (the flames are reducing to avoid any copper oxidation in the various parts of the furnace when the burners are on). A charge plate 4 with "cathode" copper is provided at the bottom of said vertical melting furnace to counter balance the burners action and maintain the molten copper 12 at a suitable temperature. The molten copper 12 temporarily flows in the dog house 6 and then, through the launders 7 to the rotary holding furnace 8 where copper 12 is still in molten state before casting on the casting wheel 9 to produce a copper rod 10. One can readily appreciate from FIG. 1 that there are some cases where the holding furnace is full of molten copper 12 because the flow rate on the casting wheel may be lower than that from the vertical melting furnace.

At that time, the burners need to be stopped to avoid any overflow of molten copper and according to the prior art technique, an air blow-down was usually made to that aim.

Figure 2:
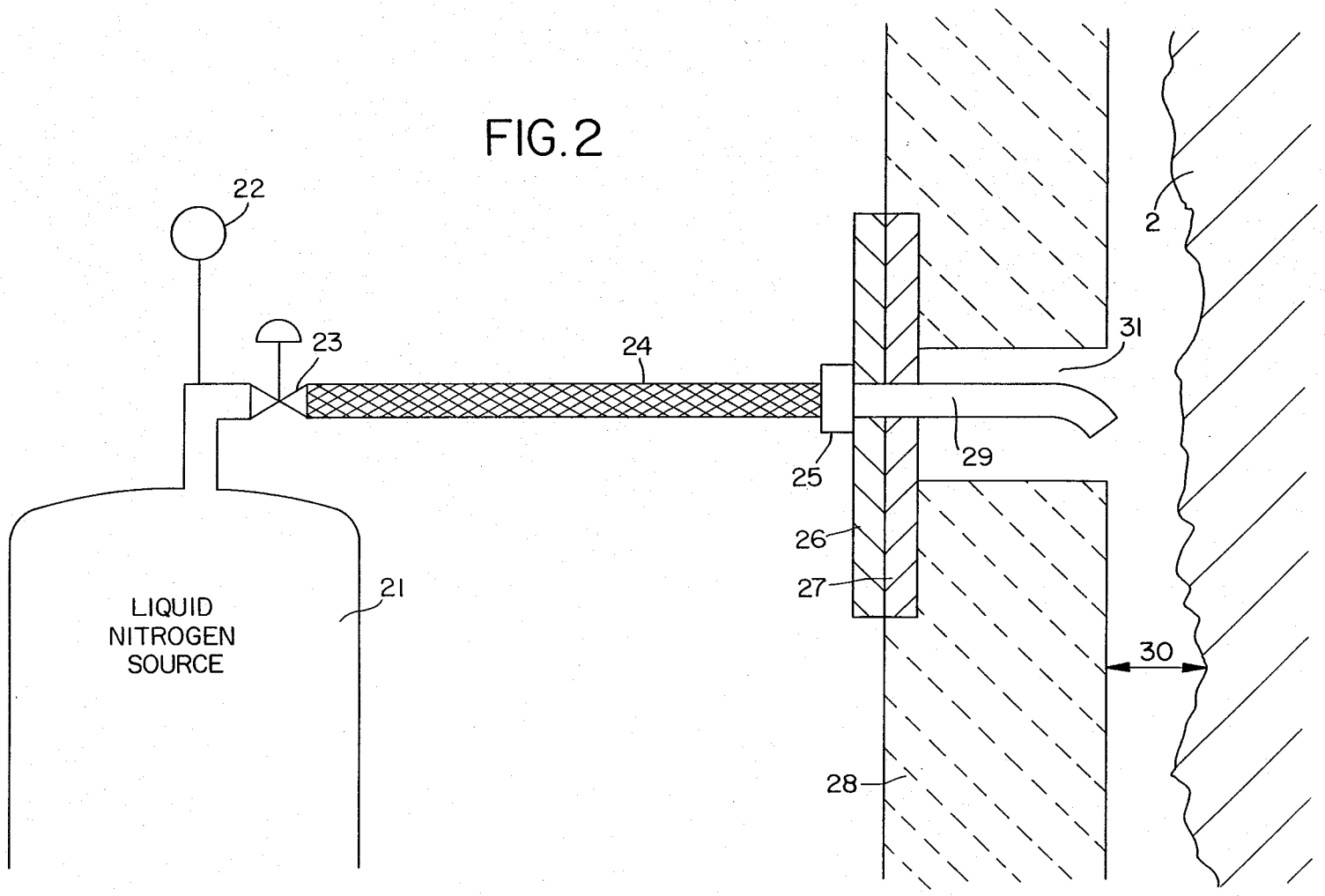
FIG. 2 is an enlarged schematic view of the inert liquid gas injection in the vertical melting furnace.

According to the invention a liquid inert gas such as nitrogen is introduced in the vertical melting furnace to blow down the copper charge, as represented on FIG. 2.

A liquid nitrogen source 21 is provided with a pressure indicator 22 and a throttling valve 23 to control the liquid nitrogen flow in the flexible hose 24 connected through the threaded connector 25 and injector flange 26 to the furnace flange 27. This connection opening 31 is generally made level with the burner's opening. The threaded connector 25 is interdependant with the liquid nitrogen injector 29 which is in the form of a cylindrical conduit having about the same diameter as the flexible hose 24, the end of which being sightly curved down in the direction of the space 30 between the copper charge 2 and the refractory lined furnace wall 28. The distance between the wall 28 and the copper charge 2 is sufficient to allow the flow of liquid nitrogen.

Liquid nitrogen injected in the opening 31 at an initial flow rate of about 4 to 6 atmospheres change per minute allows blow down of the vertical melting furnace according to the following examples.

Under normal operating conditions of a furnace, blow downs are random events. A good estimate is two blow downs per day, each lasting one hour. Trials were conducted by starting the melting process, producing good copper, stop and blow down with liquid nitrogen for 15 Minutes, then start up again just long enough to produce good copper again. Three such trials were conducted (examples 1 to 3). Another trial (example 4) using air instead of nitrogen was conducted as a control experiment. Summary data of time elapsed between nitrogen injection being terminated, the reducing burners restarted and the achievement of about 600 ppm $O_2$ content in the copper is given below :

TABLE

| EXAMPLE No. | TIME ELAPSED (min.) | $O_2$ CONTENT IN COPPER ppm |
|---|---|---|
| 1 (nitrogen) | 5.5 | 600 |
| 2 (nitrogen) | 12 | 600 |
| 3 (nitrogen) | 9 | 600 |
| 4 (air) | 45 | 600 |

For examples 1, 2 and 3, a flow rate of 15 gallon per minute has been injected for the first 5 minutes, 3 gallon per minute thereafter until restart of the burners. Time elapsed varied for those examples made in the same conditions, depending on the preparation of the liquid in the bottom of the furnace.

The 600 ppm $O_2$ content in copper is the usual standard to cast a copper rod of good quality.

According to the above results, the scrap production was reduced from 45 minutes to an average of about 9 minutes by substituting nitrogen for air in the blow down. This means that the casting recovery time was reduced by about 75%.

We claim:

1. A method to prevent oxidation during holding periods of a metal melted in a vertical melting furnace wherein said metal is melted by means of burners and flows down to a holding furnace adapted to feed a casting means, said melting of metal being occasionnally stopped during a holding period and then restarted, comprising the steps of shutting off the burners, simultaneously injecting a cryogenic inert liquid on the surface of the molten metal with a first flowrate sufficient to flush out air above the molten metal bath and to cool the melting metal below the melting point of said metal, maintaining said first flowrate on said molten metal during not more than 10 minutes to provide a non oxidizing atmosphere above the molten metal bath, then injecting a second reduced flowrate of said cryogenic liquid above said metal to maintain said non oxidizing atmosphere until said burners are restarted.

2. A method according to claim 1, further comprising the step of restarting the flow of molten metal from said furnace, measuring the oxide concentration in said molten metal and restarting casting of said molten metal as soon as the oxide concentration is lower than a predetermined value.

3. A method according to claim 2, wherein said predetermined value is equal to or lower than 600 ppm.

4. A method according to claim 1, wherein the first flowrate of cryogenic inert liquid provides about 4 to 6 atmosphere changes per minute and the second flowrate provides about one atmosphere change per minute until said burners are restarted.

5. A method according to claim 4, wherein said first flowrate is maintained for about two to five minutes.

6. A method according to claim 1, wherein said cryogenic inert liquid is selected from the group consisting of nitrogen and argon.

7. A method according to claim 4 or 5, wherein said first flowrate is about 15 gallons per minute of liquid nitrogen followed by a second flowrate of about 3 gallons per minutes of liquid nitrogen.

* * * * *